US009333756B2

(12) United States Patent
Nishimura

(10) Patent No.: US 9,333,756 B2
(45) Date of Patent: May 10, 2016

(54) INK CONTAINER AND INKJET RECORDING APPARATUS INCLUDING THE SAME

(71) Applicant: KYOCERA Document Solutions Inc., Osaka-shi (JP)

(72) Inventor: Takatoshi Nishimura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/747,852

(22) Filed: Jun. 23, 2015

(65) Prior Publication Data

US 2015/0375513 A1 Dec. 31, 2015

(30) Foreign Application Priority Data

Jun. 30, 2014 (JP) ..... 2014-133620

(51) Int. Cl.
*B41J 2/175* (2006.01)

(52) U.S. Cl.
CPC .... *B41J 2/17513* (2013.01); *B41J 2002/17516* (2013.01)

(58) Field of Classification Search
CPC ..... B41J 2/17513; B41J 2/175
USPC ..... 347/84–86
See application file for complete search history.

(56) References Cited

U.S. PATENT DOCUMENTS 8,197,045 B2 6/2012 Takeuchi
2008/0151018 A1* 6/2008 Aoki et al. ..... 347/86
2009/0256892 A1* 10/2009 Takeuchi ..... 347/86

FOREIGN PATENT DOCUMENTS

JP 2009-255312 A 11/2009

* cited by examiner

*Primary Examiner* — Julian Huffman
*Assistant Examiner* — Sharon A Polk
(74) *Attorney, Agent, or Firm* — Studebaker & Brackett PC

(57) ABSTRACT

An ink container includes an ink pack and a housing. The ink pack includes an ink containing section made from a flexible film and containing an ink therein, an ink supply port in communication with the ink containing section, and an engaging counterpart portion. The housing houses the ink pack. The housing includes a fitting portion that fits to the ink supply port of the ink pack and an engaging portion that engages with the engaging counterpart portion of the ink pack, and holds the ink pack in an ink filled state at a predetermined position in the housing through the fitting portion and the engaging portion. The engaging counterpart portion is slidable relative to the engaging portion according to lengthening of the ink pack accompanying consumption of the ink.

11 Claims, 12 Drawing Sheets

INK CONTAINER AND INKJET RECORDING APPARATUS INCLUDING THE SAME

INCORPORATION BY REFERENCE

The present application claims priority under 35 U.S.C. §119 to Japanese Patent Application No. 2014-133620, filed Jun. 30, 2014. The contents of this application are incorporated herein by reference in their entirety.

BACKGROUND

The present disclosure relates to an ink container mounted in an inkjet recording apparatus and including an ink pack and a housing that houses the ink pack. The present disclosure additionally relates to an inkjet recording apparatus including the ink pack. Note that the inkjet recording apparatus performs recording by ejecting ink onto a recording medium such as paper.

Recording apparatuses including facsimile machines, copiers, and printers record an image on a recording medium such as paper and an overhead projector film. The recording apparatuses can be classified into inkjet type, wire dot type, thermal type, etc. according to recording methods. Recording methods employable in the inkjet type can be further classified into a serial type in which recording heads perform recording while scanning a recording medium and a line head type in which recording heads fixed to a main body of a recording apparatus perform recording.

For example, line head inkjet recording apparatuses include inkjet heads (recording heads) of line head type for each color. In such a line head inkjet recording apparatus, ejection nozzles are arranged at regular intervals in terms of a direction perpendicular to a conveyance direction of a recording medium across the entire width of a printable region of the recording medium. By ejecting ink from ejection nozzles located correspondingly to printing points of the recording medium in timely manner with conveyance of the recording medium, printing can be performed on any part of the recording medium.

The inkjet recording apparatus includes an ink container for supplying ink to the recording heads. The ink container includes a flexible ink pack filled with ink and a housing that houses the ink pack.

For example, a certain recording liquid container includes an ink pack and a casing including a base piece and a covering piece. A fixing aperture is located in a peripheral part of the ink pack. A protrusion passing through the fixing aperture of the ink pack is located in the base piece. The covering piece has a hole located correspondingly to the protrusion of the base piece. The hole is in an elongated shape extending in a longitudinal direction in which the protrusion is fitted.

SUMMARY

An ink container according to a first configuration of the present disclosure includes an ink pack and a housing. The ink pack is include an ink containing section made from a flexible film and containing an ink therein, an ink supply port in communication with the ink containing section, and an engaging counterpart portion. The housing houses the ink pack. The housing includes a fitting portion that fits to the ink supply port of the ink pack and an engaging portion that engages with the engaging counterpart portion of the ink pack, and holds the ink pack in an ink filled state at a predetermined position in the housing through the fitting portion and the engaging portion. The engaging counterpart portion is slidable relative to the engaging portion according to lengthening of the ink pack accompanying consumption of the ink.

An inkjet recording apparatus according to a second configuration of the present disclosure includes the ink container according to the first configuration of the present disclosure.

DETAILED DESCRIPTION

Figure 1:
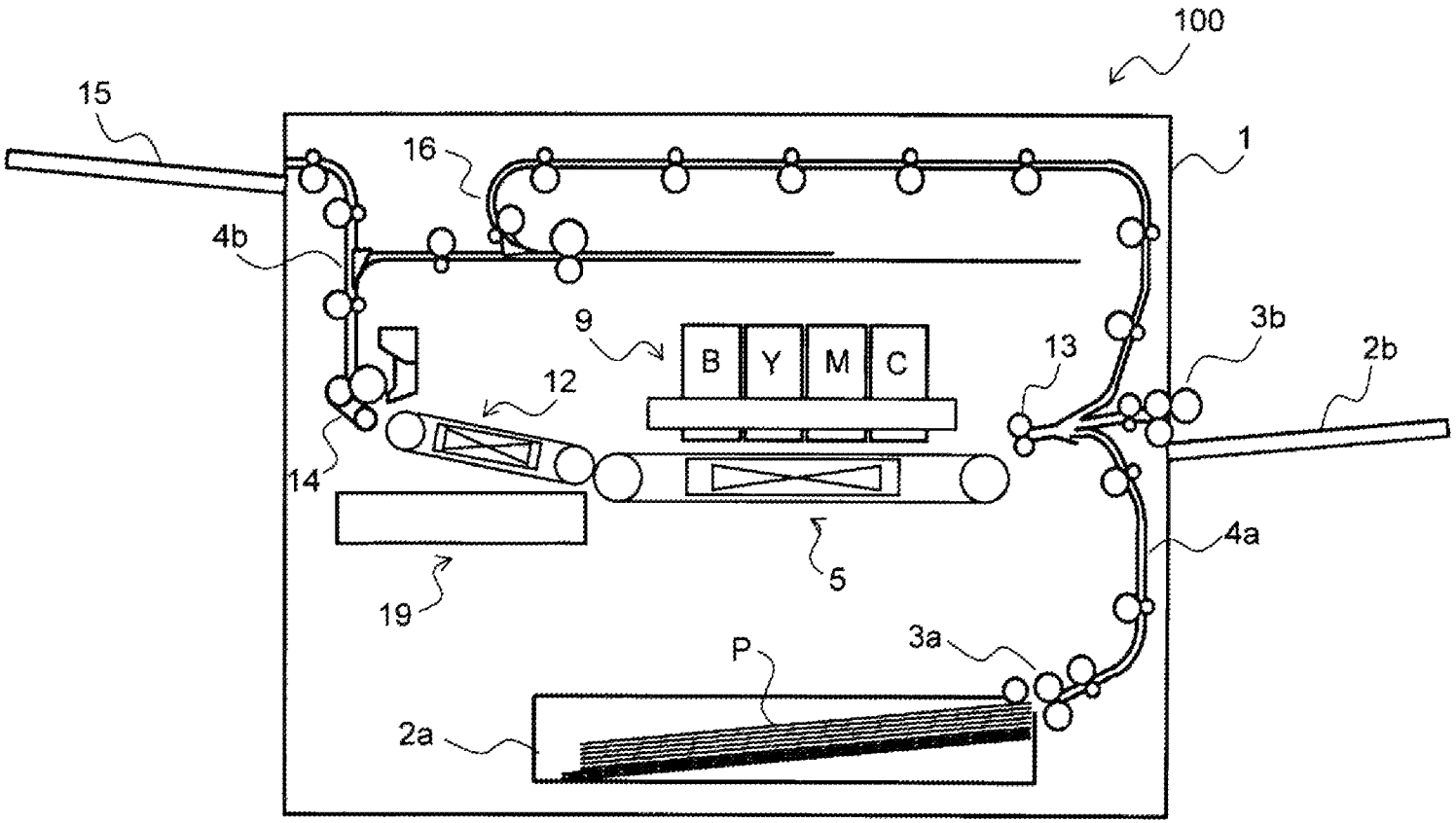
FIG. 1 is a diagram illustrating a configuration of a printer including ink containers according to the present disclosure.
Figure 2:
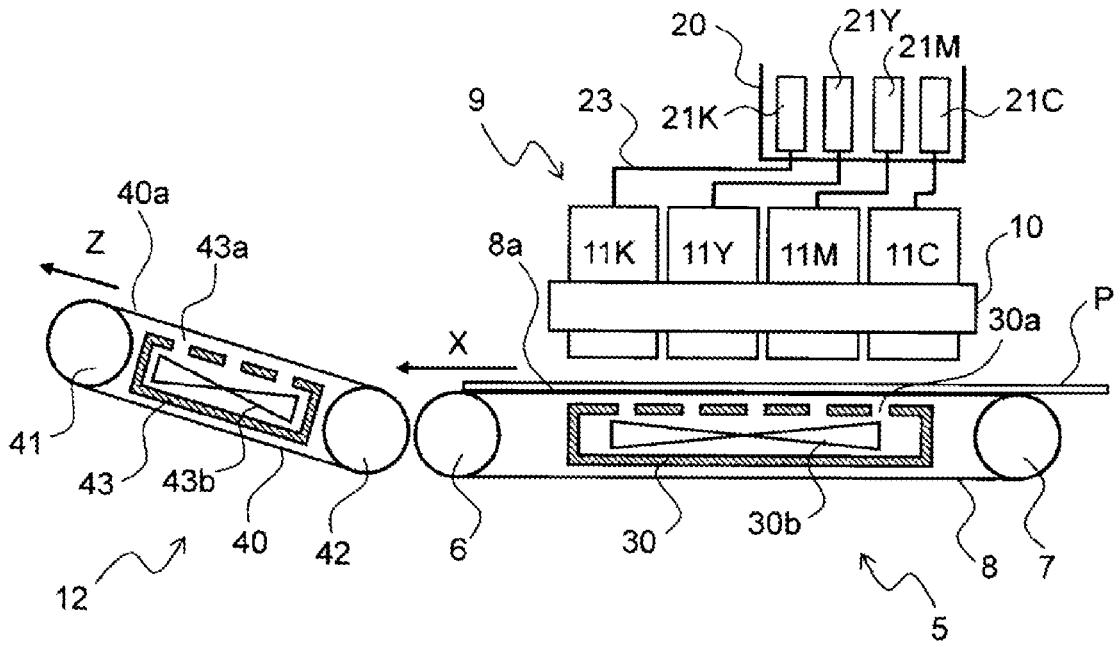
FIG. 2 is a diagram illustrating a section around a first belt conveyance unit, a recording unit, and a second belt conveyance unit in FIG. 1.
Figure 3:
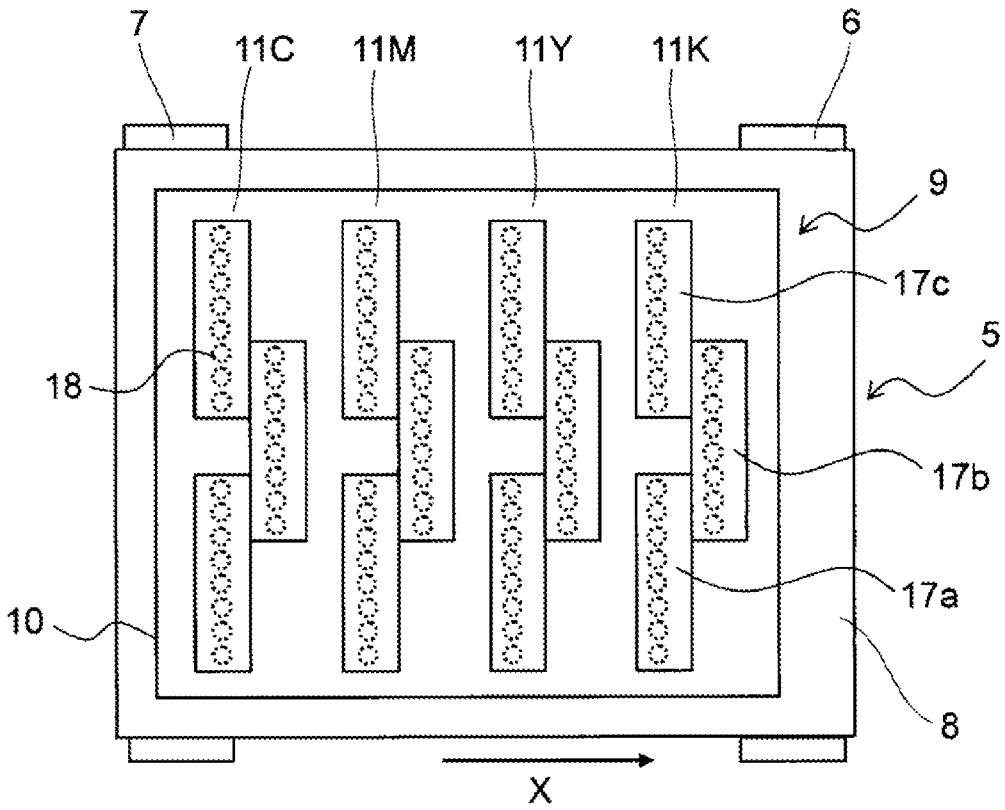
FIG. 3 is a diagram illustrating the first belt conveyance unit and the recording unit of the printer in FIG. 1 as viewed from above.

Embodiments of the present disclosure will be described below with reference to the accompanying drawings. FIG. 1 is a diagram illustrating a configuration of an inkjet printer including ink containers according to the present disclosure. FIG. 2 is an illustration of a section around a first belt conveyance unit, a recording unit, and a second conveyance unit of the printer illustrated in FIG. 1. FIG. 3 is a view illustrating the first belt conveyance unit and the recording unit of the printer in FIG. 1 as viewed from above. The inkjet printer is an example of an inkjet recording apparatus.

As illustrated in FIG. 1, a printer 100 includes a sheet feed cassette 2*a* as a sheet accommodating section arranged in a lower part of a printer main body 1 thereof. A predetermined number of sheets P (e.g., around 500 sheets) are loaded and contained in the sheet feed cassette 2*a*. The sheets P each are an example of a recording medium and may be cut paper on which printing has not yet been performed, for example. A sheet feeder 3*a* is located downstream of the sheet feed cassette 2*a* in terms of a sheet conveyance direction, that is, above a right-hand side of the sheet feed cassette 2*a* in FIG. 1. The sheet feeder 3*a* separates and then feeds the sheets P on a sheet-by-sheet basis toward the upper right of the sheet feed cassette 2*a* in FIG. 1. The sheet feed cassette 2*a* can be pulled out horizontally from the front of the printer main body 1 so that sheets P can be replenished.

A manual feed tray 2*b* is located on the right exterior of the printer main body 1. The manual feed tray 2*b* receives loading of one or more sheets. The sheet may be a recording medium different in size from the sheets P contained in the sheet feed cassette 2*a*, a recording medium difficult to pass through a winding conveyance path, such as cardboard, a viewgraph, an envelope, a postcard, a sales check, etc., or a recording medium that a user desires to feed on a sheet-by-sheet basis. Another sheet feeder 3*b* is arranged downstream of the manual feed tray 2*b* in terms of the sheet conveyance direction, that is, left of the manual feed tray 2*b* in FIG. 1. The sheet feeder 3*b* separates and feeds on a sheet-by-sheet basis, the sheets on the manual feed tray 2*b* leftward in FIG. 1.

The printer 100 further includes in the interior thereof a first sheet conveyance path 4*a*. The first sheet conveyance path 4*a* is located above and right of the sheet feed cassette 2*a* in FIG. 1. The first sheet conveyance path 4*a* is located left of the manual feed tray 2*b* in FIG. 1. A sheet P fed from the sheet feed cassette 2*a* passes through the first sheet conveyance path 4*a* vertically upward along the side surface of the printer main body 1. The sheet P fed from the manual feed tray 2*b* is conveyed substantially horizontally and leftward.

The printer 100 includes a registration roller pair 13 located at the downstream end of the first sheet conveyance path 4*a* in terms of the sheet conveyance direction. A first belt conveyance unit 5 and a recording unit 9 are arranged in a downstream vicinity of the registration roller pair 13 in terms of the sheet conveyance direction. The sheet P fed from the sheet feed cassette 2*a* or the manual feed tray 2*b* arrives at the registration roller pair 13 through the first sheet conveyance path 4*a*. The registration roller pair 13 corrects skew of the sheet P, synchronizes feeding of the sheet P to an ink ejecting operation by the recording unit 9, and feeds the sheet P toward the first belt conveyance unit 5. Note that conveyance roller pairs for sheet conveyance are arranged at appropriate points in the first sheet conveyance path 4*a*.

The first belt conveyance unit 5 includes a first drive roller 6, a first driven roller 7, and an endless first conveyance belt 8 wound therebetween. The first conveyance belt 8 is circulated by the first drive roller 6 in the anticlockwise direction in FIG. 2. The sheet P fed to the first belt conveyance unit 5 by the registration roller pair 13 is held on a conveyance surface 8*a* of the first conveyance belt 8 (the upper surface of the first conveyance belt 8 in FIG. 2) and is conveyed in an arrow direction X (from right to left) in FIG. 2. Note that one or more tension rollers in contact with an inner surface of the first conveyance belt 8 may be arranged as necessary in addition to the first drive roller 6 and the first driven roller 7.

A first sheet holder 30 faces the inner surface of the first conveyance belt 8, which is an opposite surface to the conveyance surface 8*a*. The first sheet holder 30 has an upper surface through which multiple air suction holes 30*a* pass, and includes a fan 30*b* in the interior thereof. The fan 30*b* can suck air into the first sheet holder 30 from the upper surface thereof. In addition, the first conveyance belt 8 has multiple air holes (not illustrated) for air suction. In the configuration as above, the first belt conveyance unit 5 conveys the sheet P while sucking air to hold the sheet P on the conveyance surface 8*a* of the first conveyance belt 8.

The recording unit 9 includes a head housing 10 and line heads 11C, 11M, 11Y, and 11K held by the head housing 10. The line heads 11C-11K are supported with a predetermined clearance (e.g., 1 mm) left from the conveyance surface 8*a* of the first conveyance belt 8. The line heads 11C-11K each include three recording heads 17*a*-17C. As illustrated in FIG. 3, a plurality of (three herein) recording heads 17*a*-17*c* are arranged in a staggered formation in terms of a sheet width direction (vertical direction in FIG. 3) perpendicular to the sheet conveyance direction. The respective line heads 11C-11K have recording regions. The recording regions are regions in which the respective line heads 11C-11K can form an image on the sheet P. A dimension of each of the recording regions of the line heads 11C-11K in terms of the sheet width direction is equal to or greater than the width of the sheet P. The line heads 11C-11K eject inks in respective colors according to information of image data received from an external computer or the like. The line heads 11C-11K eject the inks from ink ejection nozzles 18 located correspondingly to printing points on the sheet P conveyed while being held on the conveyance surface 8*a* of the first conveyance belt 8 by air suction. In the configuration as above, a full-color image in which four inks in yellow, magenta, cyan, and black colors are overlaid is recorded on the sheet P. Note that the printer 100 is capable of recording a monochrome image.

A container fitting unit 20 is located above the recording unit 9. A plurality of ink containers 21C, 21M, 21Y, and 21K that each contain a corresponding one of the inks in cyan (C), magenta (M), yellow (Y), and black (K) colors are detachably fitted into the container fitting unit 20. The respective ink containers 21C-21K are connected to the respective line heads 11C-11K through respective ink supply tubes 23 for the respective colors. The respective color inks are replenished and supplied to the respective line heads 11C-11K from the respective ink containers 21C-21K by utilizing ink pressure generated according to height difference between the container fitting unit 20 and the line heads 11C-11K.

Note that although the inks in the ink containers 21C-21K are supplied to the line heads 11C-11K by utilizing the height difference between the container fitting unit 20 and the line heads 11C-11K herein, an ink supply pump unit may be provided in the container fitting unit 20 for sending the inks in the ink container 21C-21K.

In order to prevent ink ejection failure caused due to drying and/or clogging in any of the recording heads 17*a*-17*c*, the recording unit 9 performs purging to prepare for a next printing operation. Purging may be performed at a printing start after a long term suspension of the printer 100 in a manner to eject the inks from all of the ink ejection nozzles 18 of the recording heads 17*a*-17*c*. Alternatively, purging may be performed in the interim of printing operations in a manner to eject an ink expected to have high viscosity from an ink ejection nozzle 18 that has ejected an amount of ink equal to or smaller than a predetermined value.

Note that the inks may be ejected from the recording heads 17*a*-17*c* by any one of various ink ejection schemes including a piezoelectric inkjet scheme, a thermal inkjet scheme, etc. In a configuration in which the piezoelectric inkjet scheme is employed, the inks are pushed out using piezoelectric elements (not illustrated). In a configuration in which the thermal inkjet scheme is employed, a heating element generates bubbles to apply pressure to the inks, thereby ejecting the inks.

A second belt conveyance unit 12 is located downstream of the first belt conveyance unit 5 in terms of the sheet conveyance direction (left in FIG. 1). The sheet P on which an ink image is recorded in the recording unit 9 is fed to the second belt conveyance unit 12. During the time when the sheet P passes through the second belt conveyance unit 12, the inks ejected onto the surface of the sheet P are dried.

The second belt conveyance unit 12 includes a second drive roller 41, a second driven roller 42, and an endless second conveyance belt 40 wound therebetween. The second conveyance belt 40 is circulated in the anticlockwise direction in FIG. 2 by the second drive roller 41. The sheet P subjected to image recording by the recording unit 9 and conveyed in the arrow direction X by the first belt conveyance unit 5 is relayed to the second conveyance belt 40 and conveyed in an arrow direction Z in FIG. 2. Note that one or more tension rollers in contact with an inner surface of the second conveyance belt 40 may be provided as necessary in addition to the second drive roller 41 and the second driven roller 42.

A second sheet holder 43 faces the inner surface of the second conveyance belt 40, which is an opposite surface to a conveyance surface 40*a*. The second sheet holder 43 has an upper surface through which multiple air suction holes 43*a* passes, and includes a fan 43*b* in the interior thereof. The fan 43*b* can suck air into the second sheet holder 43 from the upper surface thereof. In addition, the second conveyance belt 40 has multiple air holes (not illustrated) for air suction. In the configuration as above, the second belt conveyance unit 12 conveys the sheet P while sucking air to hold the sheet P on the conveyance surface 40*a* of the second conveyance belt 40.

A decurler 14 is arranged downstream of the second belt conveyance unit 12 in terms of the sheet conveyance direction in the vicinity of the left side surface of the printer main body 1. The sheet P on which the inks are dried in the second belt conveyance unit 12 is fed to the decurler 14. The decurler 14 corrects curling of the sheet P using a plurality of rollers arranged in terms of the sheet width direction.

A second sheet conveyance path 4*b* is arranged downstream of (above in FIG. 1) the decurler 14 in terms of the sheet conveyance direction. In simplex recording, the sheet P having passed through the decurler 14 is ejected onto the sheet ejection tray 15 from the second sheet conveyance path 4*b* by an ejection roller pair. The sheet ejection tray 15 is located on the left exterior of the printer 100.

A maintenance unit 19 is arranged below the second belt conveyance unit 12. The maintenance unit 19 moves to below the recording unit 9 in the aforementioned purging. The maintenance unit 19 removes ejected ink from the ink ejection nozzles 18 of the recording heads 17 (see FIG. 3) and collects the removed ink.

A reversed sheet conveyance path 16 is located above the recording unit 9 and the second belt conveyance unit 12 in the upper part of the printer main body 1. In duplex recording, a sheet P that has a first surface having been subjected to image recording and that has passed through the second belt conveyance unit 12 and the decurler 14 is fed to the reversed sheet conveyance path 16 through the second sheet conveyance path 4*b*. The sheet P fed to the reversed sheet conveyance path 16 is switched over in its conveyance direction for receiving recording on a second surface opposite to the first surface thereof. The sheet P of which the second surface is to be subjected to recording is fed rightward through the upper part in the printer main body 1. The sheet P is fed again to the first belt conveyance unit 5 through the registration roller pair 13 with the second surface thereof facing upward. Note that conveyance roller pairs for conveying the sheet P are arranged at appropriate positions in the second sheet conveyance path 4*b* and the reversed sheet conveyance path 16 similarly to those in the first sheet conveyance path 4*a*.

Figure 4:
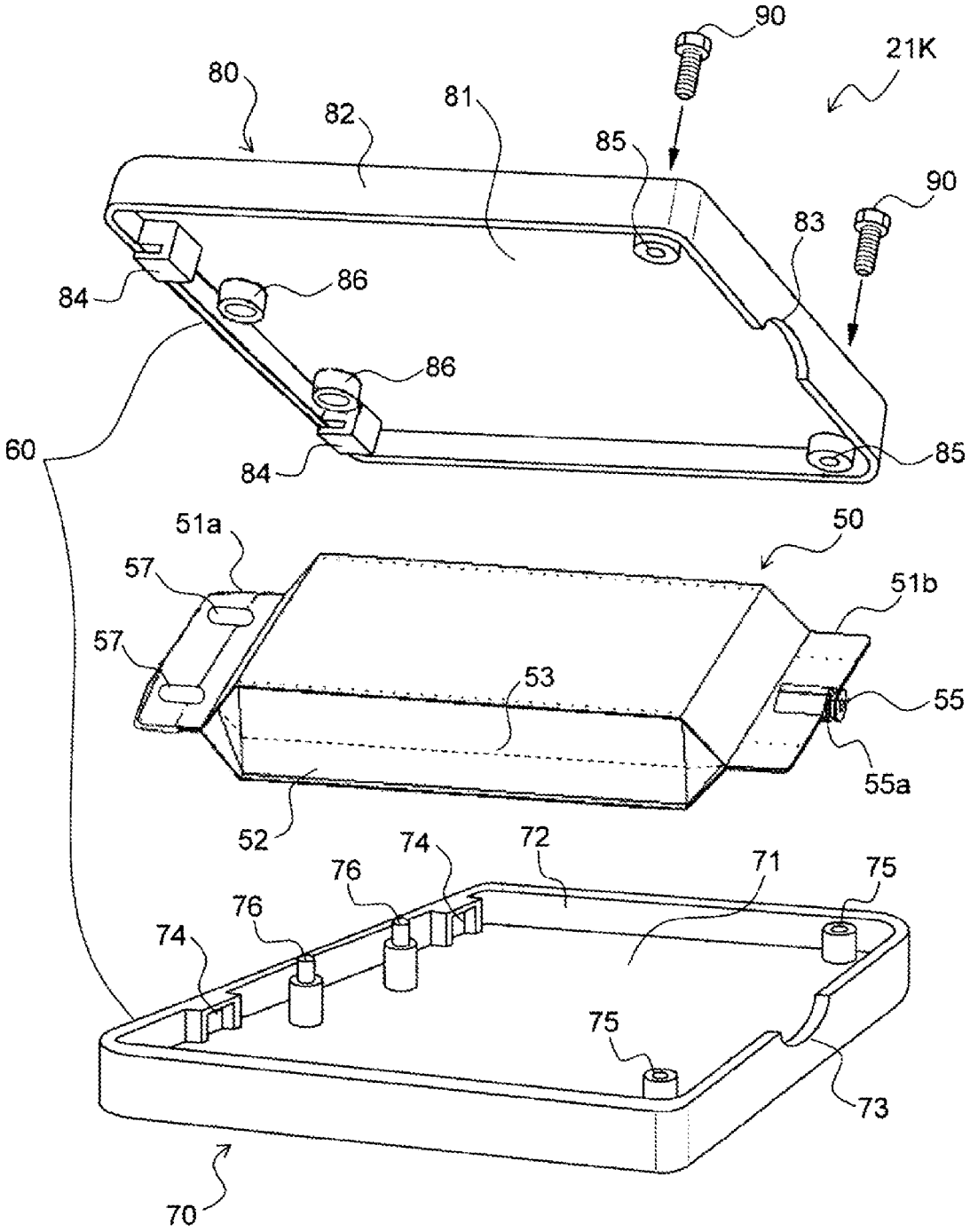
FIG. 4 is an exploded perspective view of an ink container according to a first embodiment of the present disclosure.
Figure 5:
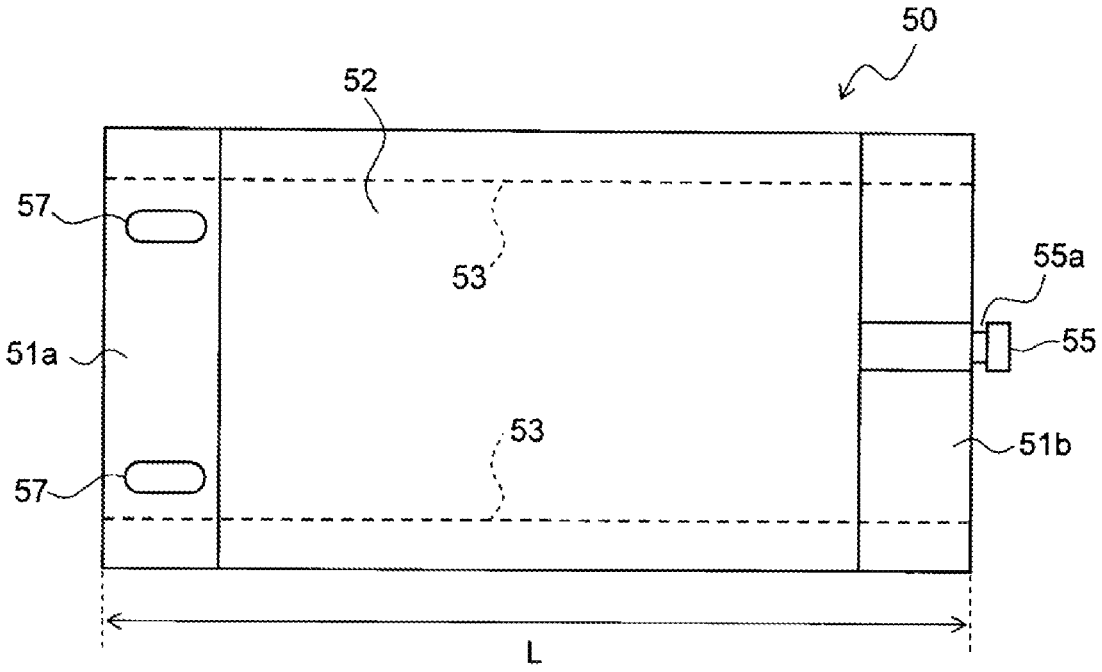
FIG. 5 is a plan view of an ink pack before being filled with an ink.
Figure 6:
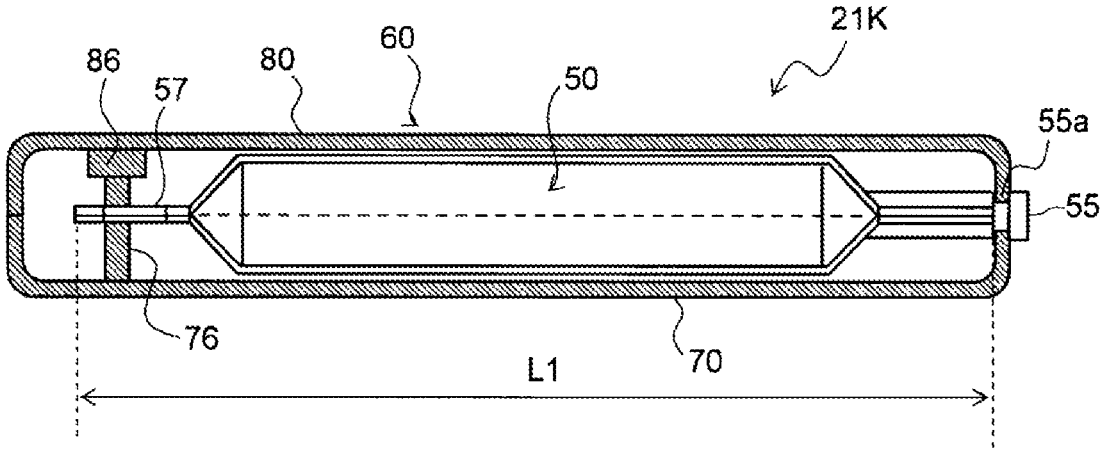
FIG. 6 is a side cross sectional view of the ink container.

FIG. 4 is an exploded view of the ink container 21K according to the first embodiment of the present disclosure. The ink container 21K supplies the black ink to the line heads 11K. FIG. 5 is a plan view of the ink pack 50 before being filled with ink. FIG. 6 is a side cross sectional view of the ink container 21K. The ink container 21K includes an ink pack 50 filled with the black ink and a housing 60 that houses the ink pack 50. Note that the ink containers 21C-21Y are the same in shape and configuration as the ink container 21K, and therefore, description of each of them is omitted.

The ink pack 50 is obtained in a manner that: opposite end parts of a single laminated film (not illustrated in FIGS. 4-6), which is one example of a flexible film, are attached together so that a cylindrical shape is obtained; one of the opposite end parts in the cylindrical shape is heat-sealed to obtain a first seal portion 51*a*; an ink is filled into an ink containing section 52; and then the other of the end parts in the cylindrical shape is heat-sealed to form a second seal portion 51*b*. The ink containing section 52 of the ink pack 50 has side surfaces each serving as a gusset (folded portion) with a bend line 53 for allowing the ink containing section 52 to have a given thickness. The gusset is foldable along the bend line 53. The ink pack 50 may be a so-called gusset bag. A cylindrical ink supply port 55 in communication with the ink containing section 52 is located in the second seal portion 51*b* among four peripheral parts of the ink pack 50. The ink supply port 55 is made from polyethylene and has an annular grooved portion 55*a* along the periphery in the vicinity of the tip end part thereof.

As illustrated in FIGS. 4 and 6, the ink pack 50 including the ink containing section 52 in which the ink is filled is in a state in which the gusset folded into the ink containing section 52 distends. A dimension L1 of the ink pack 50 in the longitudinal direction in this state is shorter than a dimension L of the ink pack 50 in the longitudinal direction before the ink is filled by the thickness that the distending ink containing section 52 has.

The first seal portion 51*a* of the ink pack 50 has two guide apertures 57. The guide apertures 57 each extend in the longitudinal direction of the ink pack 50 (right and left directions in FIGS. 5 and 6).

The housing 60 includes a base piece 70 and a covering piece 80 each of which is made from polystyrene, for example. The base piece 70 and the covering piece 80 are assembled together to be in a shape of a flat rectangular parallelepiped box. The ink pack 50 is housed in the box.

The base piece 70 includes a rectangular bottom portion 71 and a first peripheral wall standing at the peripheral edge of the bottom portion 71. The first peripheral wall 72 has a semicircle first fitting portion 73 to which the grooved portion 55*a* of the ink supply port 55 of the ink pack 50 is fitted. Two engaging portions 74 for engagement with the covering piece 80 are located opposite to the first fitting portion 73 on the inner surface of the first peripheral wall 72. The bottom portion 71 has two screw holes 75 having internal threads on an inner surface thereof and two boss portions 76 that are inserted through the two guide apertures 57 in the ink pack 50.

The covering piece 80 includes a rectangular upper surface portion 81 and a second peripheral wall standing at the peripheral edge of the upper surface portion 81. A semicircle second fitting portion 83 to which the grooved portion 55*a* of the ink supply port 55 of the ink pack 50 is fitted is located on the second peripheral wall 82 opposite to the first fitting portion 73. Two engaging claws 84 for engagement with the engaging portions 74 of the base piece 70 are located opposite to the second fitting portion 83 on the inner surface of the second peripheral wall 82. The upper surface portion 81 has two screw through holes 85 and two recessed boss holes 86 to which the boss portions 76 of the base piece 70 are inserted.

In order to assemble the base piece 70 and the covering piece 80 together, the ink pack 50 is first set on the bottom portion 71 of the base piece 70. The ink pack 50 is set in such a manner that the guide apertures 57 in the first seal portion 51*a* are inserted into the boss portions 76 while the grooved portion 55*a* of the ink supply port 55 of the second seal portion 51*b* is fitted into the first fitting portion 73 of the base piece 70.

The covering piece 80 is then overlaid on the base piece 70 so that the second peripheral wall 82 is joined to the first peripheral wall 72. As a result, the bottom portion 71 faces the upper surface portion 81 with the ink pack 50 therebetween. The engaging portions 74 of the base piece 70 engage with the engaging claws 84 of the covering piece 80, and the boss portions 76 are inserted into the boss holes 86. As a result, the base piece 70 and the covering piece 80 are positioned in the horizontal direction. Thereafter, two screws 90 are inserted into the screw insertion holes 85 and screwed into the screw holes 75 through the screw insertion holes 85, thereby firmly fixing the covering piece 80 to the base piece 70.

Figure 7:
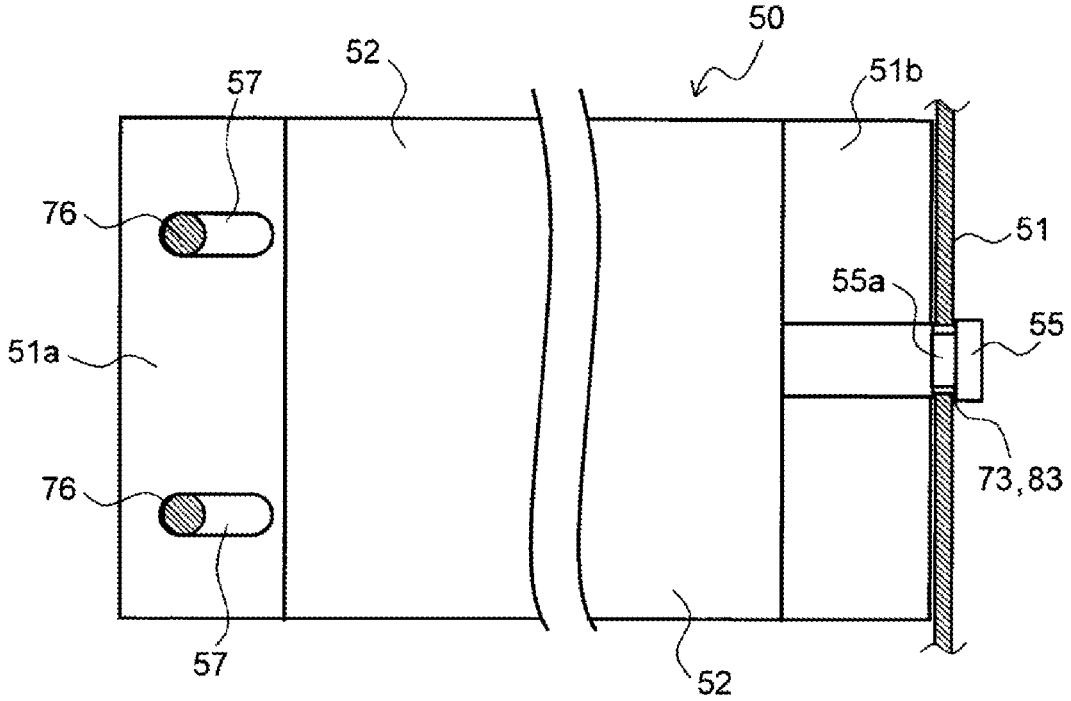
FIG. 7 is a diagram illustrating engagement between a housing and opposite end parts of the ink pack in a longitudinal direction in an ink filled state.

As to the ink pack 50, the grooved portion 55*a* of the ink supply port 55 of the second seal portion 51*b* is caught between the first fitting portion 73 of the base piece 70 and the second fitting portion 83 of the covering piece 80 and the respective guide apertures 57 in the first seal portion 51*a* receive insertion of the respective boss portions 76. In the above configuration, as illustrated in FIG. 7, the boss portions 76 are in contact with end edges of the elongated guide apertures 57 located furthest away from the first and second fitting portions 73 and 83 (left in FIG. 7). In this manner, the ink pack 50 of which the ink containing section 52 distends with the ink filled therein is housed in the housing 60 in a fashion in which the opposite end parts thereof in the longitudinal direction (i.e., the first and second seal portions 51*a* and 51*b*) are firmly held by the first and second fitting portions 73 and 83 and the boss portions 76, respectively.

In the above configuration, movement of the ink pack 50 in the housing 60 is restricted even in a situation in which vibration or impact is applied to the ink container 21K from the outside of the ink container 21K during transportation or the like. Thus, wrinkles other than the bend line 53 tend not to form in the ink pack 50. As a result, in response to decrease in internal pressure of the ink pack 50 accompanying a decrease in the amount of ink in the ink pack 50, the ink pack 50 can easily collapse flat along the bend line 53. Further, insertion of the boss portions 76 into the boss holes 86 can obviate the possibility of the guide apertures 57 slipping out of the boss portions 76.

Incidentally, when the aforementioned ink containers 21C-21K are fitted to the container fitting unit 20 to supply the inks to the respective line heads 11C-11K, the amount of the ink in each of the ink packs 50 decreases. As the amount of the ink in each of the ink packs 50 decreases, the internal pressure of each of the ink packs 50 decreases. As a result, the ink pack 50 deflates in the thickness direction. As the ink pack 50 deflates, the dimension of the ink pack 50 in the longitudinal direction becomes longer.

Figure 8:
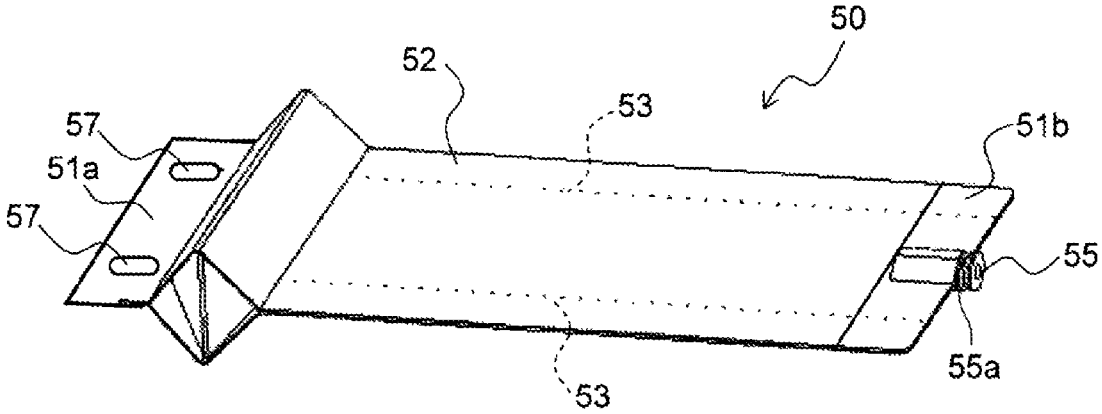
FIG. 8 is a perspective view of the ink pack in a state in which ink consumption has progressed.
Figure 9:
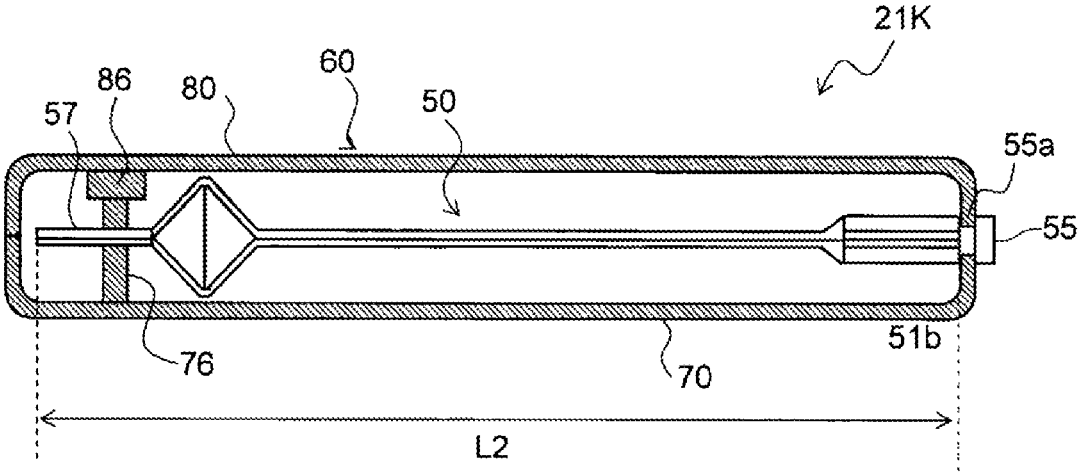
FIG. 9 is a side cross sectional view of the ink container in a state in which consumption of ink in the ink pack has progressed.

Specifically, as illustrated in FIGS. 8 and 9, the gusset (folded portion) that is the side surface of the ink containing section 52 is refolded into the ink containing section 52 along the bend line 53 to reduce the dimension of the ink pack 50 in the thickness direction. During the time when the ink pack 50 is filled with the ink (see FIGS. 4 and 6), the gusset as the side surface of the ink containing section 52 extends. This means that a dimension L2 of the ink pack 50 in the longitudinal direction when the ink is consumed is longer than the dimension L1 thereof in the longitudinal direction when the ink is filled (see FIG. 6). When supposed, for example, that the gusset type ink pack 50 can be filled with a maximum of 1 liter of an ink, a difference in dimension of the ink pack in the longitudinal direction is 2-3 cm between in a filled state and in an empty state.

In the present embodiment, the guide apertures 57 in the first seal portion 51*a* that receive insertion of the boss portions 76 of the base piece 70 of the housing 60 each have an elongated shape in the longitudinal direction, in other words, extend in a direction in which the ink pack 50 lengthens. In the above configuration, the boss portions 76 are in contact with the edge parts of the guide apertures 57 that are located away from the first and second fitting portions 73 and 83 (see left side in FIG. 7) in a state in which the ink pack 50 is filled with the ink. Accordingly, movement of the ink pack 50 in the longitudinal direction can be restricted, so that the ink pack 50 can hardly move around in the housing 60 in response to vibration or impact during transportation. As a result, the ink pack 50 can be prevented from being irregularly wrinkled.

The ink pack 50 is not fixed at opposite end parts thereof in the longitudinal direction, that is, the first and second seal portions 51*a* and 51*b* to the housing 60 in a filled state in the present embodiment. In the above configuration, lengthening of the ink pack 50 accompanying a decrease in amount of the ink in the ink pack 50 can be mitigated, thereby preventing the ink pack 50 from warping in the thickness direction. As a result, the ink pack 50 can collapse flat to lengthen in the longitudinal direction. In other words, the ink pack 50 can deform spontaneously as the ink amount decreases. In turn, the ink pack 50 can be prevented from irregularly deforming in any part thereof other than a part along which the bend line 53 is located.

Moreover, when the ink in each ink pack 50 in the ink containers 21C-21K fitted into the container fitting unit 20 is consumed, the ink pack 50 gradually lengthens in the longitudinal direction. In the second seal portion 51*b* which is one of the end parts of the ink pack 50 in the longitudinal direction (the direction in which the ink pack 50 lengthens), the grooved portion 55*a* of the ink supply port 55 engages with the housing 60 to restrict movement of the ink pack 50. In the first seal portion 51*a* as the other of the end parts of the ink pack 50 in the longitudinal direction, the long guide apertures 57 elongating in the direction in which the ink pack 50 lengthens receive insertion of the boss portions 76 so that the boss portions 76 and the guide apertures 57 are slidable relative to one another. In the above configuration, influence of lengthening of the ink pack 50 in the longitudinal direction that accompanies consumption of the ink in the ink pack 50 can be reduced. The configuration as above does not inhibit spontaneous deformation of the ink pack 50, so that the ink pack 50 can collapse flat along the bend line 53. Therefore, the amount of remaining ink in the ink pack 50 can be reduced as far as possible before replacement of the ink pack 50 becomes necessary.

Figure 10:
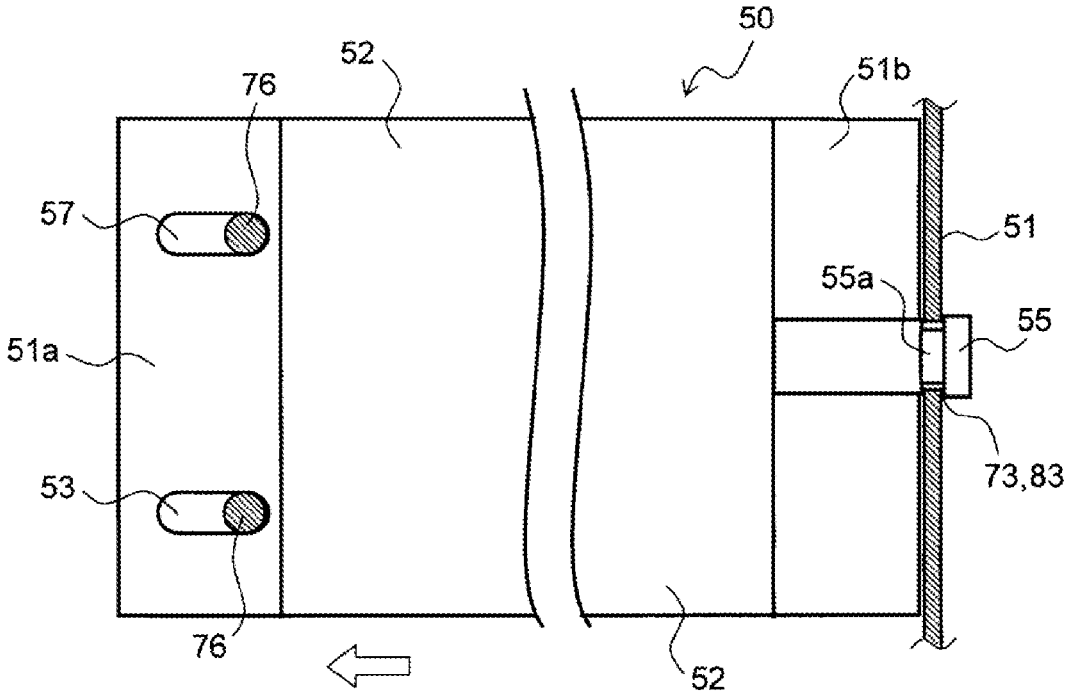
FIG. 10 is a diagram illustrating engagement between the housing and the opposite end parts of the ink pack in the longitudinal direction in which ink consumption advances.

Preferably, the inner length of the guide apertures 57 in the longitudinal direction is equal to or greater than a maximum amount (L2−L1) to which the ink pack 50 lengthens. It is also preferable that the inner width of the guide apertures 57 in a direction perpendicular to the longitudinal direction thereof is substantially equal to the diameter of the boss portions 76 in order to restrict movement of the ink pack 50 in the direction perpendicular to the longitudinal direction thereof (vertical direction in FIG. 10).

Note that although the two guide apertures 57 are located in the first seal portion 51*a* herein, the number of the guide apertures 57 may be one or three or more. Specifically, the number of the guide apertures 57 may be increased or decreased as appropriate in view of retention and collapsibility of the ink pack 50 in the housing 60.

Figure 11:
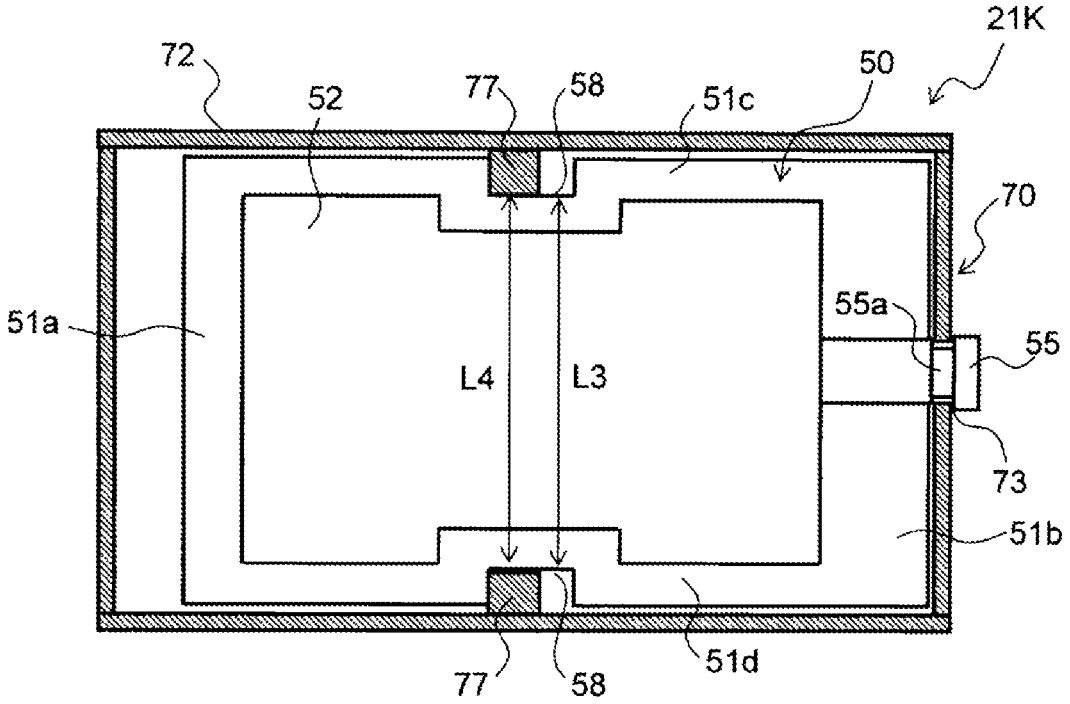
FIG. 11 is a diagram illustrating a state in which a covering piece of an ink container according to a second embodiment of the present disclosure is removed, wherein the ink pack is in an ink filled state.
Figure 12:
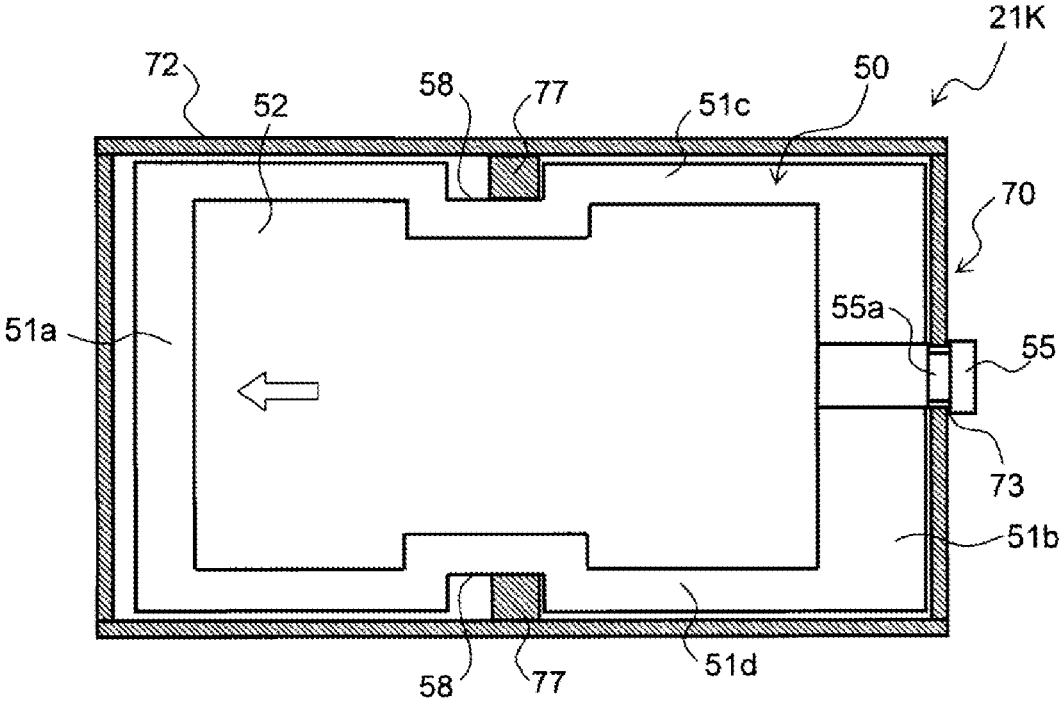
FIG. 12 is a diagram illustrating a state in which consumption of the ink in the ink pack has progressed from the state illustrated in FIG. 11.

FIGS. 11 and 12 each illustrate a state in which a covering piece 80 of an ink container 21K according to a second embodiment of the present disclosure is removed. FIG. 11 illustrates an ink pack 50 in an ink filled state. FIG. 12 illustrates a state in which the ink in the ink pack 50 is consumed. Note that the ink containers 21C-21Y have the same shape and configuration as the ink container 21K, and therefore, repeated description is omitted.

The ink pack 50 of the ink container 21K in the present embodiment is a four-side-sealed ink pack in which respective four side portions of two laminated films are heat sealed together to form the first to fourth seal portions 51*a*-51*d*. An ink containing section 52 of the ink pack 50 has a shape notched in the central part in the longitudinal direction. Each of the third and fourth seal portions 51*c* and 51*d* that are located on the opposite side end parts of the ink pack 50 in the traverse direction has a rectangular notch 58 along the notched shape of the ink containing section 52.

The first peripheral wall 72 of the base piece 70 includes two protrusions 77 at positions each corresponding to one of the two notches 58 in the ink pack 50. The protrusions 77 protrude inward of the first peripheral wall 72. The protrusions 77 extend in a height direction of base piece 70 to be in contact with the upper surface portion 81 (see FIG. 4) of covering piece 80. The other elements of the base piece 70 and the covering piece 80 have the same configurations as those in the first embodiment.

In the present embodiment, the respective notches 58 in the third and fourth seal portions 51*c* and 51*d* that engage with the respective protrusions 77 of the base piece 70 of the housing 60 extend in the direction in which the ink pack 50 lengthens, that is, the longitudinal direction. In a situation in which the ink is filled in the ink pack 50 in the above configuration, as illustrated in FIG. 11, the respective protrusions 77 are in contact with the respective edges of the notches 58 that are located away from the first and second fitting portions 73 and 83 (see left in FIG. 11) in the ink pack 50. This can restrict movement of the ink pack 50 in the longitudinal direction. As a result, the ink pack 50 can hardly move around in the housing 60 in response to vibration or impact during transportation.

As the ink in each ink pack 50 in the ink containers 21C-21K fitted into the container fitting unit 20 is consumed, the ink pack 50 lengthens gradually. As illustrated in FIG. 12, in the second seal portion 51*b* which is one of the opposite end parts of the ink pack 50 in the longitudinal direction, the grooved portion 55*a* of the ink supply port 55 engages with the housing 60 to restrict movement of the ink pack 50. In the third and fourth seal portions 51*c* and 51*d* which are side end parts of the ink pack 50 in the longitudinal direction, the notches 58 extending in the direction in which the ink pack 50 lengthens are each caught by corresponding one of the protrusions 77. This configuration can reduce influence of lengthening of the ink pack 50 in the longitudinal direction. Thus, the ink pack 50 can spontaneously deform to collapse flat along the bend line 53. Therefore, the amount of remaining ink in the ink pack 50 can be reduced as far as possible before replacement of the ink pack 50 becomes necessary.

Preferably, the dimension of the notches 58 in the longitudinal direction is equal to or greater than a maximum amount (L2−L1) to which the ink pack 50 lengthens. In order to restrict movement of the ink pack 50 in the direction (vertical direction in FIGS. 11 and 12) perpendicular to the longitudinal direction, a crosswise distance L3 between the two notches 58 is preferably, substantially equal to a crosswise distance L4 between the protrusions 77.

The present disclosure is not limited to the above embodiments and can be modified in various manners within the scope not departing from the subject matter of the present disclosure. For example, the first embodiment employs the ink pack 50 of the so-called gusset bag type in which the gusset (folded portion) with the bend line 53 is located in each of the side surfaces of the ink containing section 52. However, the ink pack 50 is not limited to such a gusset type and may be a three-side-sealed bag type in which three sides of two flexible films are sealed or four-side-sealed bag type in which four sides of two flexible films are sealed.

In a configuration with an ink pack 50 of the three- or four-side-sealed bag type, the guide apertures 57 engaging with the boss portions 76 may be located in side seal portions at the respective side end parts of the ink pack 50. However, in order to optimally reduce the influence of lengthening of the ink pack 50 in the longitudinal direction, which accompanies ink consumption, it is preferable that the guide apertures 57 are located in a seal portion that seals a peripheral part of the ink pack 50 at an opposite end of the ink pack 50 to the ink supply port 55.

Furthermore, although the ink containers 21C-21K are mounted in the line head inkjet printer 100 that performs recording using the recording heads 17 fixed to the main body 1 (recording apparatus body) in each of the above embodiments, the ink containers 21C-21K are applicable to a serial inkjet printer that performs recording by scanning a recording medium using recording heads.

In addition, the inkjet recording apparatus in each of the above embodiments uses the four inks of yellow, magenta, cyan, and black colors to obtain full color images. However, the present disclosure is applicable to an inkjet recording apparatus using color inks having other hues and an inkjet recording apparatus using a number of color inks other than four.

What is claimed is:

1. An ink container comprising:

an ink pack including an ink containing section made from a flexible film and containing an ink therein, an ink supply port in communication with the ink containing section, and an engaging counterpart portion; and a housing that houses the ink pack, wherein the housing includes a fitting portion that fits to the ink supply port of the ink pack and an engaging portion that engages with the engaging counterpart portion of the ink pack, and holds the ink pack in an ink filled state at a predetermined position in the housing through the fitting portion and the engaging portion, the engaging counterpart portion is slidable relative to the engaging portion according to lengthening of the ink pack accompanying consumption of the ink, an amount to which the engaging counterpart portion of the ink pack is slidable relative to the engaging portion is equal to or greater than a maximum amount to which the ink pack lengthens, and the maximum amount to which the ink pack lengthens is a length obtained by subtracting a dimension of the ink pack in a longitudinal direction in an ink filled state from a dimension of the ink pack in the longitudinal direction in an empty state.

2. The ink container according to claim 1, wherein the engaging counterpart portion of the ink pack engages with the engaging portion of the housing to restrict movement of the ink pack in a direction perpendicular to a direction in which the ink pack lengthens.

3. The ink container according to claim 1, wherein the ink pack has a seal portion that seals a peripheral part of the ink pack, the engaging counterpart portion includes one or more guide apertures that are located in the seal portion and elongate in a direction in which the ink pack lengthens, and the engaging portion includes one or more boss portions that each engage with a corresponding one of the one or more guide apertures.

4. The ink container according to claim 3, wherein the guide apertures are located in the seal portion, the seal portion being located at an opposite end of the ink pack to the ink supply port.

5. The ink container according to claim 3, wherein the ink pack is a gusset bag obtained in a manner that: opposite end parts of a single flexible film are attached together so that a cylindrical shape is obtained; one of opposite end parts in the cylindrical shape is heat-sealed to obtain the ink containing section; an ink is filled in the ink containing section; the other of the end parts in the cylindrical shape is heat sealed; and side surfaces of the ink containing section are folded and set inward along bend lines.

6. The ink container according to claim 1, wherein the engaging counterpart portion includes a pair of notches located on respective opposite side end parts of the ink pack in a direction perpendicular to a direction in which the ink pack lengthens, and the engaging portion includes a pair of protrusions that each are caught by a corresponding one of the notches.

7. An inkjet recording apparatus comprising the ink container according to claim 1.

8. The ink container according to claim 1, wherein a dimension of the ink pack in the longitudinal direction when the ink is consumed is longer than the dimension thereof in the longitudinal direction in the ink filled state.

9. The ink container according to claim 8, wherein the housing has a space in which the ink pack in the empty state is able to be housed.

10. An ink container comprising:

an ink pack including an ink containing section made from a flexible film and containing an ink therein, an ink supply port in communication with the ink containing section, and an engaging counterpart portion;

a housing that houses the ink pack; and a seal portion that seals a peripheral part of the ink pack, wherein the housing includes a fitting portion that fits to the ink supply port of the ink pack and an engaging portion that engages with the engaging counterpart portion of the ink pack, and holds the ink pack in an ink filled state at a predetermined position in the housing through the fitting portion and the engaging portion, and the engaging counterpart portion is slidable relative to the engaging portion according to lengthening of the ink pack accompanying consumption of the ink, the engaging counterpart portion includes one or more guide apertures that are located in the seal portion and elongate in a direction in which the ink pack lengthens, and the engaging portion includes one or more boss portions that each engage with a corresponding one of the one or more guide apertures, and the ink pack is a gusset bag obtained in a manner that: opposite end parts of a single flexible film are attached together so that a cylindrical shape is obtained; one of opposite end parts in the cylindrical shape is heat-sealed to obtain the ink containing section; an ink is filled in the ink containing section; the other of the end parts in the cylindrical shape is heat sealed; and side surfaces of the ink containing section are folded and set inward along bend lines.

11. An ink container comprising:

an ink pack including an ink containing section made from a flexible film and containing an ink therein, an ink supply port in communication with the ink containing section, and an engaging counterpart portion; and a housing that houses the ink pack, wherein the housing includes a fitting portion that fits to the ink supply port of the ink pack and an engaging portion that engages with the engaging counterpart portion of the ink pack, and holds the ink pack in an ink filled state at a predetermined position in the housing through the fitting portion and the engaging portion, and the engaging counterpart portion is slidable relative to the engaging portion according to lengthening of the ink pack accompanying consumption of the ink, and the engaging counterpart portion includes a pair of notches located on respective opposite side end parts of the ink pack in a direction perpendicular to a direction in which the ink pack lengthens, and the engaging portion includes a pair of protrusions that each are caught by a corresponding one of the notches.

* * * * *